US006772446B1

(12) United States Patent
Black

(10) Patent No.: US 6,772,446 B1
(45) Date of Patent: Aug. 10, 2004

(54) WOMEN'S UNDERGARMENT WITH SANITARY PAD POCKETS

(76) Inventor: Ronnell Black, 2915 N. 47th St., Milwaukee, WI (US) 53210

( * ) Notice: Subject to any disclaimer, the term of this patent is extended or adjusted under 35 U.S.C. 154(b) by 0 days.

(21) Appl. No.: 10/077,009

(22) Filed: Feb. 15, 2002

(51) Int. Cl.[7] ..... A41B 9/02
(52) U.S. Cl. ..... 2/406; 2/400
(58) Field of Search ..... 2/400–408, 67, 2/228, 238, 227, 78.1–78.3, 69, 79, 247, 250, 253; 450/94.95, 150, 153; 604/354, 358, 385.03, 385.06, 385.19, 386, 387, 393, 394, 397, 401, 402

(56) References Cited

U.S. PATENT DOCUMENTS 3,871,030 A * 3/1975 Green ..... 2/238
5,067,178 A 11/1991 Katchka
5,093,935 A 3/1992 Countee, Jr.
5,144,694 A * 9/1992 Conrad Da oud et al. ..... 2/69
5,172,430 A * 12/1992 Lerma-Solis ..... 2/400
5,182,815 A * 2/1993 Young ..... 2/406
5,561,865 A * 10/1996 Fjelstul ..... 2/227
5,724,679 A * 3/1998 Hans ..... 2/238
6,018,823 A * 2/2000 Ortmeier ..... 2/406
6,041,445 A * 3/2000 Davitt ..... 2/400
6,076,195 A * 6/2000 Klein ..... 2/400
6,308,340 B1 * 10/2001 Cook ..... 2/400
6,363,538 B1 * 4/2002 Davis ..... 2/247

* cited by examiner

*Primary Examiner*—Gloria M. Hale
(74) *Attorney, Agent, or Firm*—Andrus, Sceales, Starke & Sawall, LLP

(57) ABSTRACT

A women's undergarment includes a fabric body having a back, a front, side portions connecting the front and the back, a top, a bottom and a crotch. A waistband is secured to the top of the fabric body, and leg openings are provided at the bottom of the fabric body separated by the crotch. Pocket structure is connected to and coextensive with the side portions of the fabric body. The pocket structure has side edges attached to a bottom edge and a top edge. Either the top edge or the bottom edge is open. The pocket structure is sized and shaped to receive a women's sanitary pad through the open edge.

13 Claims, 5 Drawing Sheets

WOMEN'S UNDERGARMENT WITH SANITARY PAD POCKETS

FIELD OF THE INVENTION

This invention relates broadly to women's apparel and, more particularly, pertains to women's undergarments formed with storage pockets especially useful in holding and concealing feminine hygiene products.

BACKGROUND OF THE INVENTION

Women's undergarments of the type worn above the lower trunk of the body assume a variety of forms using various amounts of material to create differently sized panties or the like. In as much as such garments are meant to be worn beneath outer garments and clothing, such undergarments have not been normally designed or intended to particularly carry personal items of the wearer. Although recent advancements have been made in the apparel art for the security of routinely carried personal items and valuables such as currency, credit cards, keys, identification, etc., in secure locations incorporated within the undergarment, such advancements are not directed to enabling a female to specifically carry a feminine hygiene product/sanitary pad on her person.

The use of undergarments with pockets is known in the prior art. More specifically, undergarments with pockets previously offered for the purpose of storing small objects are generally comprised of various structural arrangements notwithstanding the many designs of the prior art which have been developed for certain objectives and requirements.

By way of example, U.S. Pat. No. 6,076,195 to Klein discloses an undergarment having a series of pockets provided on a front side thereof. U.S. Pat. No. 6,018,823 to Ortmeier shows a women's undergarment with a rear pouch for holding a microphone pack. U.S. Pat. No. 5,067,178 discloses an undergarment with an integral pocket such as for storing condoms.

While these patents provide their intended objectives, none of these set forth a women's undergarment with one or more pockets which wrap around the sides of the undergarment to surreptitiously store a sanitary pad.

In this regard, the women's undergarment with side pockets provides an article of apparel developed for the purpose of permitting a woman to conceal a sanitary pad immediately adjacent her body.

Whereas the prior art has traditionally provided purses, handbags and various carrying cases for sanitary pads, there is a continuing need for a women's undergarment with a wrap around pocket structure for retaining sanitary pads in a manner which will give a woman an enhanced sense of confidence and privacy.

SUMMARY OF THE INVENTION

It is a general object of the present invention to provide a women's undergarment which has private pocket structure for women in need of discretely attending to their menstrual cycles.

It is also an object of the present invention to provide a women's undergarment which has private pocket structure for allowing concealment and permitting convenient access to feminine hygiene products.

It is a further object of the present invention to provide a women's undergarment with at least one storage pocket for receiving a full size sanitary pad.

It is an additional object of the present invention to provide a women's undergarment that alleviates the need to carry women's sanitary pads in a purse, handbag, gym bag or pocket of an outer garment.

It is another object of the present invention to provide a women's undergarment which will eliminate the need to carry a purse or handbag into a restroom, stop frequent trips to school or work lockers and prevent the embarrassing moments of sanitary pads accidentally falling from outer garment pockets or handbags and exposing the pads when opening a purse or handbag.

In another object of the present invention is used to provide a women's undergarment having pocket structure for holding several sanitary pads so as to meet the needs of a menstruating woman for an entire day.

In one aspect of the invention, there is provided a women's undergarment including a fabric body having a back, a front, side portions connecting the front and the back, a top, a bottom and a crotch. A waistband is secured to the top of the fabric body and leg openings are provided at the bottom of the fabric body separated by the crotch. Pocket structure is connected to and is located in the side portions of the fabric body. The pocket structure has a pair of side edges, a bottom edge and a top edge, either the top edge or the bottom edge being open, the pocket structure being sized and shaped to receive a women's sanitary pad through the open edge. In the preferred embodiment, the pocket structure includes a first pair of identically sized pockets, each having a top edge opening along the waistband. The pocket structure further includes a second pair of identically sized pockets, each being located beneath a respective pocket of the first pair and having a top edge parallel to the bottom edge of a respective pocket of the first pair. The pocket structure is generally rectangular shaped and is connected to an exterior face of the fabric body. The pocket structure is coextensive with the side portions of the fabric body.

In a alternative embodiment, the pocket structure further includes a flap connected to and encircling the top of the fabric body beneath and in partial overlapping relationship with a bottom portion of the first pair of pockets, the flap defining a supplemental pocket for holding miscellaneous items. The flap has a continuous lower edge secured around the entire periphery at the top of the fabric body, and a continuous open upper edge which overlies the bottom portion of the first pair of pockets. The flap may also have a continuous upper edge secured about the periphery of the fabric body and a continuous unsecured lower edge which may be pulled up to conceal the first pair of pockets.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION

Figure 1:
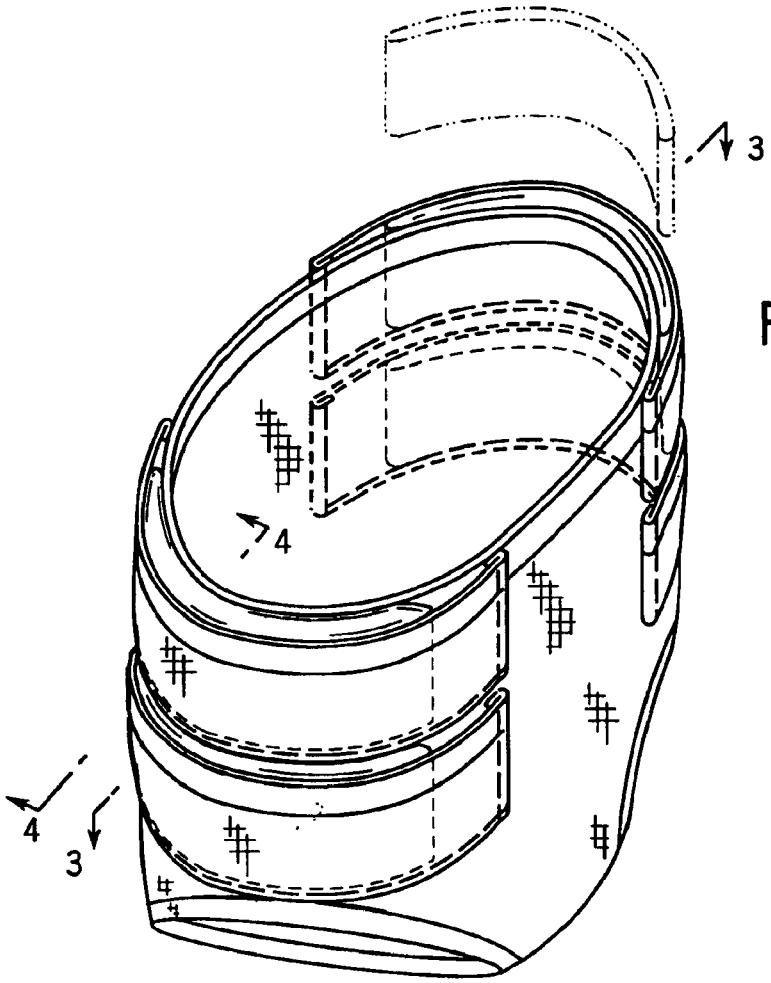
FIG. 1 is a perspective view of a preferred embodiment of a women's undergarment embodying the present invention.
Figure 2:
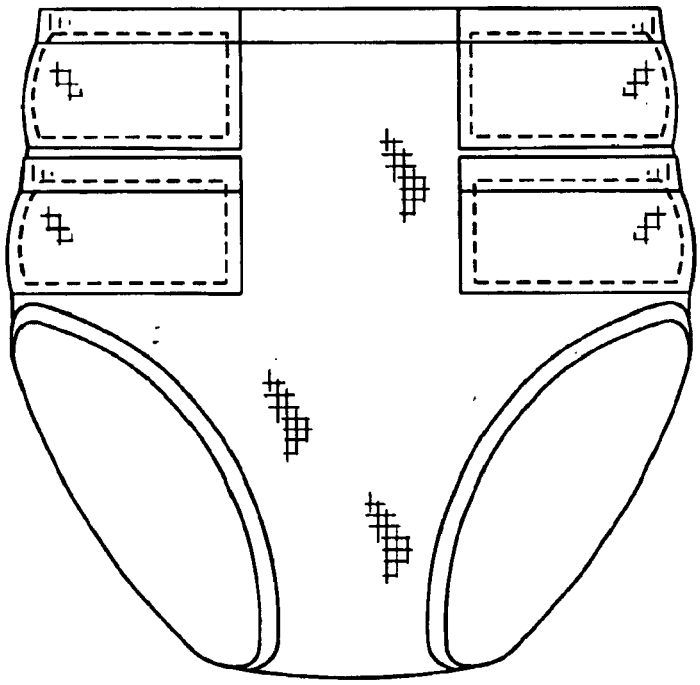
FIG. 2 is a front view of the undergarment shown in FIG. 1.
Figure 3:
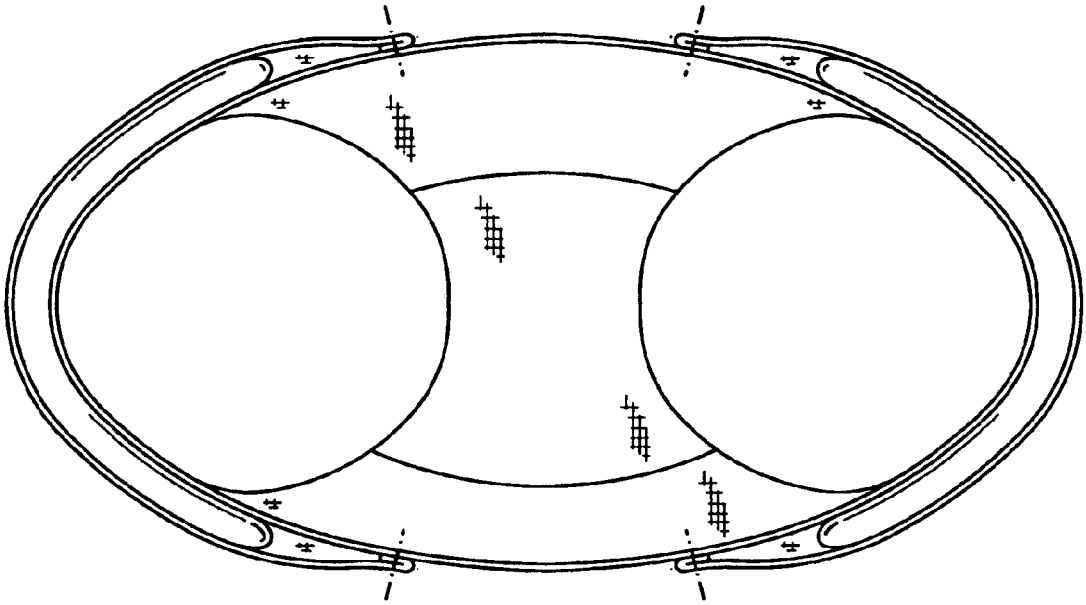
FIG. 3 is a top view of the undergarment shown in FIG. 1.
Figure 7:
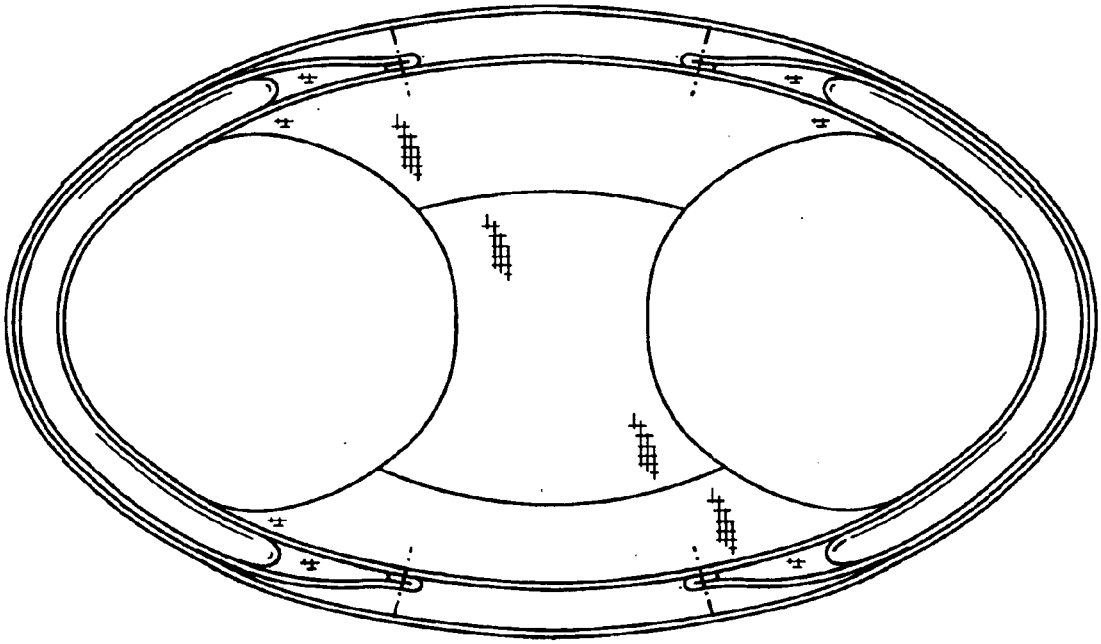
FIG. 7 is a top view of the undergarment shown in FIG. 5.
Figure 4:
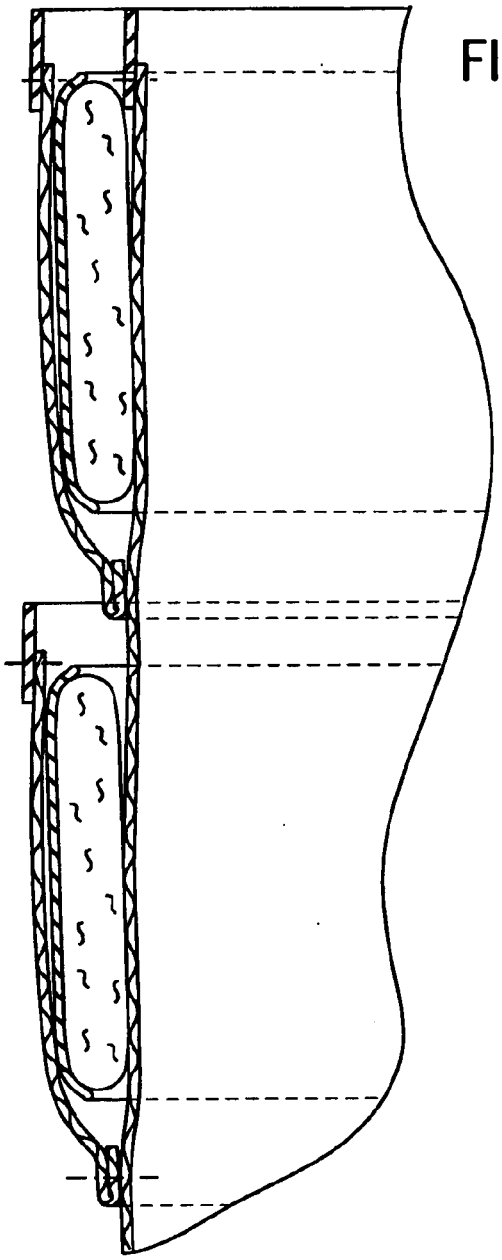
FIG. 4 is a sectional view taken on line 4—4 of FIG. 1.
Figure 8:
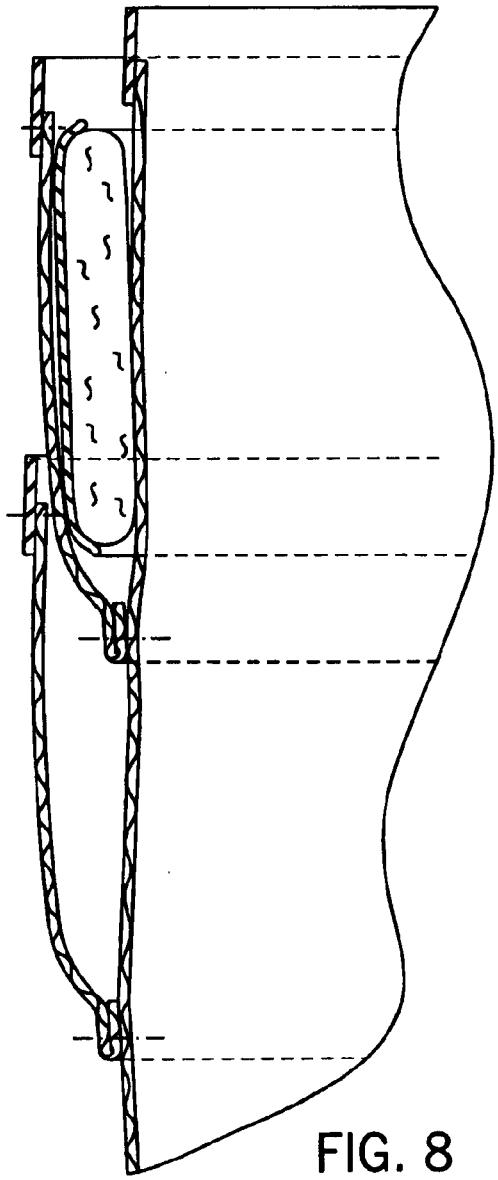
FIG. 8 is a sectional view taken on line 8—8 of FIG. 5.
Figure 5:
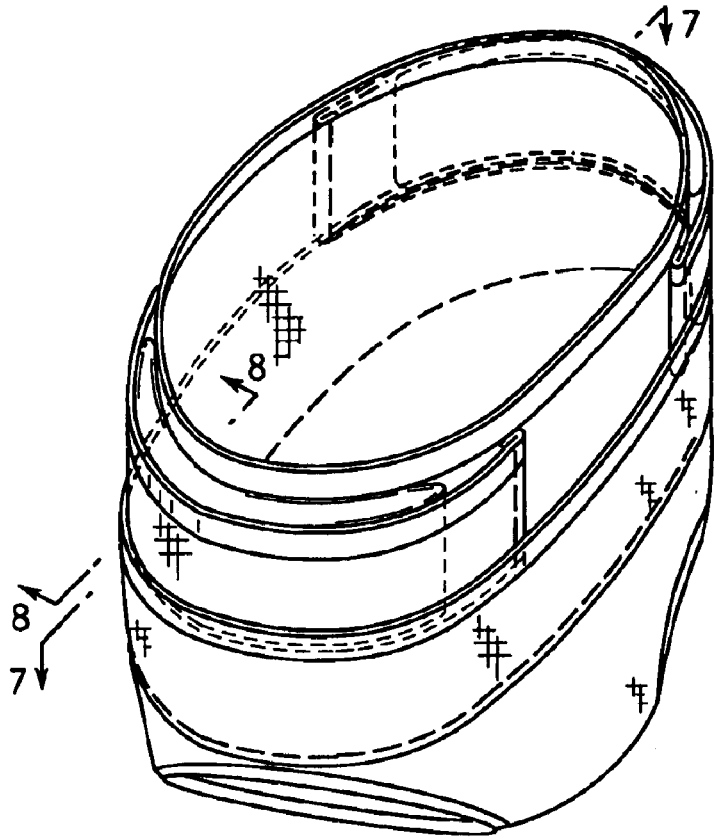
FIG. 5 is a perspective view of an alternative embodiment of the present invention.
Figure 6:
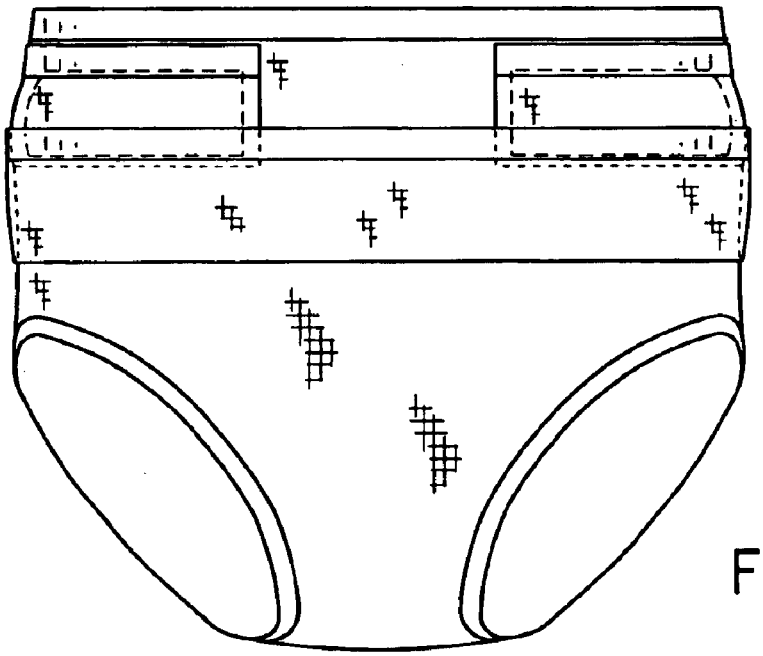
FIG. 6 is a front view of the undergarment shown in FIG. 5.

Referring now to the drawings, FIGS. 1–4 illustrate a women's undergarment 10 having a fabric body 12 with a back 14, a front 16, side portions 18, 20 connecting the back 14 and the front 16, a top 22, a bottom 24, and a crotch 26 which joins the back 14 and the front 16. A waistband 28 is secured to and encircles the top 22 of the fabric body 12. A pair of leg openings 30, 32 are formed in the bottom 24 and are reinforced around the peripheral edges by leg bands 34 which are separated by crotch 26.

In accordance with the invention, pocket structure is connected to, such as by stitching 36 or the like, and coextensive with the side portions 18, 20 of the fabric body 12. The pocket structure preferably takes the form of a generally rectangular shaped, first pair of pockets 38, 40 sewn, for example, to an exterior surface of the fabric body 12 in the top 22 and side portions 18, 20 thereof. Each pocket 38, 40 is identical in shape and size and includes a pair of generally vertical side edges 42, 44 attached to an elongated bottom edge 46, and an open elongated top edge 48 which is aligned with the waistband 28 throughout the side portions 18, 20 for receiving a women's sanitary pad 50 that is shown as being of the full size type. It can be appreciated however, that smaller sizes of women's sanitary pads can be stored in the pockets 38, 40.

Figure 9:
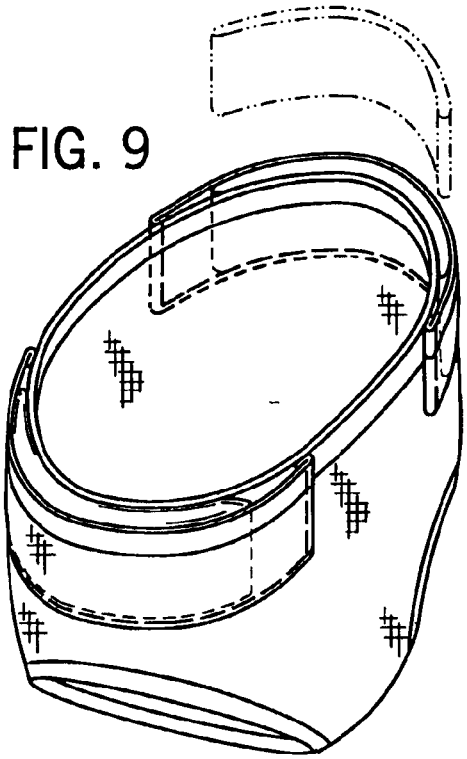
FIG. 9 is a view like FIG. 1 showing the undergarment with one pair of pockets.

The pocket structure further includes a generally rectangular shaped second pair of pockets 52, 54 also sewn such as by stitching 36 to the exterior surface of the fabric body 12 in the top 22 and side portions 18, 20 thereof below the first pair of pockets 38, 40. Like pockets 38, 40, each pocket 52, 54 has a pair of generally vertical side edges 56, 58 attached to an elongated bottom edge 60, and an open elongated top edge 62. Each top edge 62 lies parallel to the bottom edge 46 of its respective pocket 38 or 40 and is unsewn to receive another full size sanitary pad 64. By providing two pair of wrap around pockets 38, 40, 52, 54, the wearer of the undergarment 10 is conveniently and discreetly enabled to carry four full size sanitary pads 50, 64 to meet the needs of a menstruating female for generally an 8 to 12 hour range. It should be understood that the pocket structure may also take the form of a single pocket 38 or 40, or a single pair of pockets 38, 40 as shown in FIG. 9.

In use, a woman simply places a sanitary pad 50, 64 desired in the pockets 38, 40, 52, 54, secures her outer garments in place, and proceeds with her regular activities. The wearer can be assured that the sanitary pads 50, 64 are completely hidden from view beneath her outer garment. When necessary, the woman goes to a restroom or other private location, loosens her outer garment and quickly accesses the desired sanitary pad, all in a matter of seconds without having to fumble around in a purse or a handbag which is not necessary to carry due to the present invention.

FIGS. 5 through 8 illustrate an alternative embodiment of the present invention. The undergarment 10' is similar to undergarment 10 with the exception of having only a single pair of pockets 38', 40' and a flap 66 which is attached to the fabric body 12' and encircles the top 22' of the undergarment 10' beneath and in partial overlapping relationship with the bottom portion of the pockets 38', 40'. Flap 66 has a continuous lower edge 68 secured such as by stitching 36' around the entire upper periphery of the undergarment 10'. Flap 66 also has a continuous open upper edge 70 typically made of elastic which overlies a bottom portion of pocket 38'. Flap 66 thus defines an auxiliary or supplemental pocket which can hold other feminine products, such as napkins, panty shields, tampons, etc., as well as miscellaneous items such as keys, credit cards, identification, money, etc. The alternative embodiment thus contemplates a pair of side portion wrap around pockets 38', 40' for full-size sanitary pads 50' combined with a completely encircling flap 66 for carrying additional pads or other items therebelow.

Figure 10:
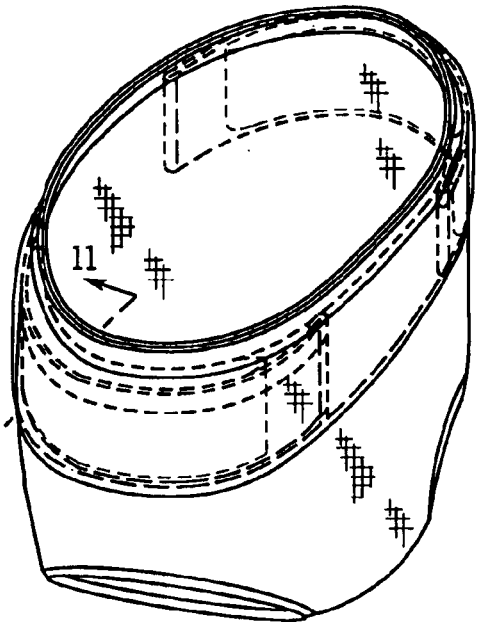
FIG. 10 is a view like FIG. 5 but showing the flap pulled up to conceal the pockets.
Figure 11:
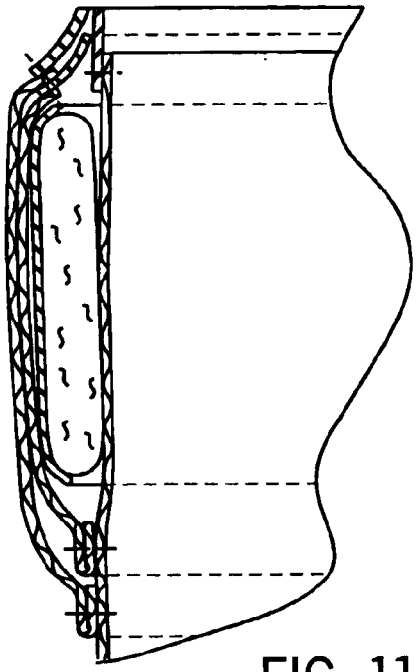
FIG. 11 is a sectional view taken on line 11—11 of FIG. 10 showing the flap pulled up to conceal the pockets.

In FIG. 10, the upper edge 70 is sewn about its periphery while the bottom edge 68 is left unsewn so it may be pulled up over the pockets 38', 40'. As shown in FIG. 11, the flap 66 may be pulled up over the top edge 48' so that it totally conceals the pockets 38', 40', if desired.

It should be understood that while not shown, it may be desirable to close the top edges 48, 62 of the pockets 38, 40 with a closure such as a Velcro® hooked and loop fastener, a zipper or the like. It should also be understood that the flap 66 provides a support for the pads 50' in the upper pockets 38', 40' or it can be used itself to conceal and carry the pads 50'.

Figure 12:
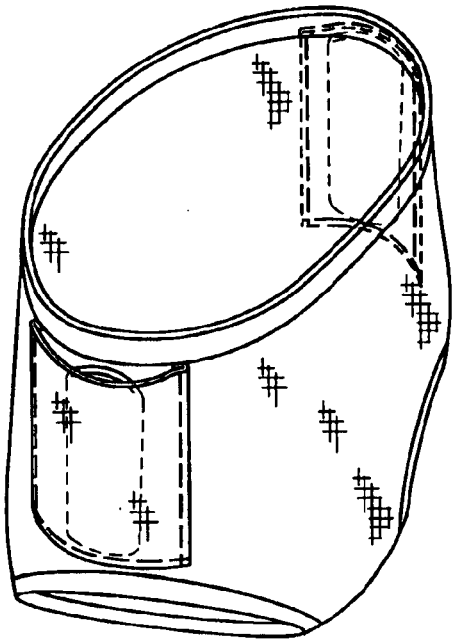
FIG. 12 is another alternative embodiment showing a vertically oriented set of pockets in the side portions of the fabric body.

FIG. 12 shows another alternative embodiment wherein the pockets 38, 40 are vertically oriented in the side portions of the fabric body 12 rather than horizontally oriented.

While the preferred embodiment shows the top edges 48, 48', 62, 62' of the pocket structure as being open to accept the sanitary pads 50, 50', it should be appreciated that the bottom edges 46, 60, 46', 68, may alternatively be open to accept the sanitary pads while the top edges 48, 48' and side edges 42, 44, 56, 58, 42', 44' are closed. In such case, the bottom edges 46, 60, 46', 68 would preferably be made of an elastic material or include a closure device which would retain the sanitary pad therein.

The present invention thus provides an enhanced women's undergarment 10, 10' which is capable of being mass produced at a reasonable cost and which is of use to a wide age group of women seeking an improved method of transporting and accessing sanitary products. The present invention substantially eliminates the compromising, embarrassing situations often experienced by women when feminine hygiene products accidentally fall from an outer garment or are exposed when opening a purse or a handbag.

While the invention has been described with reference to a preferred embodiment, those skilled in the art will appreciate that certain substitutions, alterations and omissions may be made without departing from the spirit thereof. For example, the pockets of the women's undergarment are entirely capable of holding and concealing bladder control pads and panty liners for urinary continence. Accordingly, the foregoing description is meant to be exemplary only and should not be deemed limitative on the scope of the invention as set forth in the following claims.

I claim:

1. A women's undergarment comprising:

a fabric body having a back, a front, side portions connecting the front and the back, a top, a bottom and a crotch;

a waistband secured to the top of the fabric body;

leg openings at the bottom of the fabric body separated by the crotch; and pocket structure connected to and located in the side portions of the fabric body, the pocket structure having a pair of side edges, a bottom edge, and a top edge, either the top edge or the bottom edge being open, the pocket structure being sized and shaped to receive a women's sanitary pad through the open edge, wherein the pocket structure includes a first pair of identically sized pockets, each having a top edge opening along the waistband, and wherein the pocket structure further includes a flap connected to and encircling the top of the fabric body beneath and in partial overlapping relationship with a bottom portion of the first pair of pockets, the flap defining a supplemental pocket for holding miscellaneous items.

2. The women's undergarment of claim 1, wherein the flap has a continuous lower edge secured around an entire periphery at the top of the fabric body, and a continuous open upper edge which overlies the bottom portion of the first pair of pockets.

3. The women's undergarment of claims 1, wherein the pocket structure is coextensive with the side portions of the fabric body.

4. A women's undergarment comprising:

a legless fabric body having a back, a front, side portions connecting the front and the back and adapted to extend along a wearer's hips, a top, a bottom and a crotch;

a waistband secured to the top of the fabric body;

leg openings at the bottom of the fabric body separated by the crotch and adapted to receive a wearer's legs; and pocket structure connected to, located in and extending substantially entirely around the side portions of the fabric body over the hips of a wearer above the crotch between the waistband and the leg openings, the pocket structure having a pair of side edges, a bottom edge, and a top edge, either the top edge or the bottom edge being open, wherein the top edge is adjacent the waistband and the pocket structure being sized and shaped to receive a women's sanitary pad through the open edge.

5. The women's undergarment of claim 4, wherein the pocket structure includes a first pair of identically sized pockets, each having a top edge opening along the waistband.

6. The women's undergarment of claim 5, wherein the pocket structure further includes a second pair of identically sized pockets, each being located beneath a respective pocket of the first pair and having a top edge parallel to the bottom edge of the respective pocket of the first pair.

7. The women's undergarment of claim 4, wherein the pocket structure is generally rectangularly shaped, and is connected to an exterior surface of the fabric body.

8. The women's undergarment of claim 5, wherein the pocket structure further includes a flap connected to and encircling the top of the fabric body beneath and in partial overlapping relationship with a bottom portion of the first pair of pockets, the flap defining a supplemental pocket for holding miscellaneous items.

9. The women's undergarment of claim 8, wherein the flap has a continuous lower edge secured around an entire periphery at the top of the fabric body, and a continuous open upper edge which overlies the bottom portion of the first pair of pockets.

10. The women's undergarment of claim 5, wherein the pocket structure includes a flap connected to and encircling the top of the fabric body, the flap having a continuous upper edge secured around an entire periphery of the fabric body and a continuous unsecured lower edge which may be pulled up to conceal the first pair of pockets.

11. The women's undergarment of claim 4, wherein the pocket structure is coextensive with the side portions of the fabric body.

12. A women's undergarment comprising:

a fabric body having a back, a front, side portions connecting the front and the back, a top, a bottom and a crotch; and pocket structure connected to and located in the side portions of the fabric body, the pocket structure having a pair of side edges, a bottom edge, and a top edge, either the top edge or the bottom edge being open, the pocket structure being sized and shaped to receive a women's sanitary pad through the open edge, wherein the pocket structure includes a first pair of identically sized pockets, each having a top edge opening along the waistband, and wherein the pocket structure further includes a second pair of identically sized pockets, each being located beneath a respective pocket of the first pair and having a top edge parallel to the bottom edge of the respective pocket of the first pair.

13. The women's undergarment of claim 12, wherein the pocket structure is generally rectangularly shaped, and is connected to an exterior surface of the fabric body.

* * * * *